US011781418B2

(12) United States Patent
Hoeie et al.

(10) Patent No.: US 11,781,418 B2
(45) Date of Patent: Oct. 10, 2023

(54) WELL ANNULUS PRESSURE MONITORING

(71) Applicant: CONOCOPHILLIPS COMPANY, Houston, TX (US)

(72) Inventors: Bjoernar Hoeie, Tananger (NO); Tore Morten Hiim, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 16/951,835

(22) Filed: Nov. 18, 2020

(65) Prior Publication Data

US 2021/0156244 A1 May 27, 2021

Related U.S. Application Data

(60) Provisional application No. 62/938,814, filed on Nov. 21, 2019.

(51) Int. Cl.

| | |
|---|---|
| ***E21B 47/007*** | (2012.01) |
| ***E21B 47/117*** | (2012.01) |
| ***E21B 21/08*** | (2006.01) |

(52) U.S. Cl.

CPC ..... *E21B 47/007* (2020.05); *E21B 21/08* (2013.01); *E21B 47/117* (2020.05)

(58) Field of Classification Search

CPC ..... E21B 47/007; E21B 47/117

See application file for complete search history.

(56) References Cited

U.S. PATENT DOCUMENTS

| | | | | |
|---|---|---|---|---|
| 4,610,161 | A * | 9/1986 | Gehrig | E21B 21/08 175/48 |
| 5,091,780 | A * | 2/1992 | Pomerleau | G08B 13/19697 348/262 |
| 5,293,323 | A * | 3/1994 | Doskocil | G06F 11/2273 714/25 |
| 5,389,125 | A * | 2/1995 | Thayer | B01D 53/0454 95/115 |
| 5,602,761 | A * | 2/1997 | Spoerre | G01H 1/003 702/179 |
| 7,711,486 | B2 | 5/2010 | Thigpen et al. | |
| 9,249,657 | B2 * | 2/2016 | Sipilä | E21B 41/0007 |
| 9,803,467 | B2 * | 10/2017 | Tang | E21B 43/267 |

(Continued)

FOREIGN PATENT DOCUMENTS

| | | | | |
|---|---|---|---|---|
| AU | 2013248201 | B2 * | 3/2017 | E21B 41/0007 |
| EP | 2910730 | A2 | 8/2015 | |
| WO | 2014039463 | A1 | 3/2014 | |

OTHER PUBLICATIONS

Sultan et al. "Real-Time Casing Annulus Pressure Monitoring in a Subsea HPHT Exploration Well," OTC=19286 (Year: 2008).*

(Continued)

*Primary Examiner* — John Fitzgerald

(74) *Attorney, Agent, or Firm* — ConocoPhillips Company

(57) ABSTRACT

The invention relates to the monitoring of pressure in production tubing (3) and/or annuli (7, 9) of an oil or gas well. Patterns of pressure in tubing and/or annuli may be indicative of a fault or a condition which requires attention. Patterns may also be recognized that, e.g. based in rates of change, may indicate that a fault may be going to occur in the future. Pressure differences between tubing and annuli or between different annuli may be monitored in the same way.

4 Claims, 5 Drawing Sheets

(56) References Cited

U.S. PATENT DOCUMENTS

| | | | | |
|---|---|---|---|---|
| 11,261,712 | B2 * | 3/2022 | Muraikhi | E21B 34/02 |
| 2001/0027865 | A1 | 10/2001 | Wester | |
| 2005/0222772 | A1 * | 10/2005 | Koederitz | E21B 21/106 702/6 |
| 2010/0314104 | A1 | 12/2010 | Shokanov | |
| 2013/0173167 | A1 * | 7/2013 | Abitrabi | G01V 9/00 702/6 |
| 2013/0173168 | A1 * | 7/2013 | Abitrabi | E21B 43/32 702/6 |
| 2014/0039836 | A1 * | 2/2014 | Moricca | F04D 15/0088 702/184 |
| 2014/0116715 | A1 * | 5/2014 | Sipila | E21B 47/06 166/336 |
| 2014/0214326 | A1 * | 7/2014 | Samuel | E21B 47/006 702/11 |
| 2014/0259172 | A1 * | 9/2014 | Wang | G06F 21/566 726/23 |
| 2014/0285337 | A1 * | 9/2014 | Gebhardt | B60R 25/102 340/521 |
| 2016/0208595 | A1 * | 7/2016 | Tang | E21B 43/26 |
| 2016/0273346 | A1 | 9/2016 | Tang et al. | |
| 2019/0112912 | A1 * | 4/2019 | Thompson | E21B 33/0422 |
| 2021/0348490 | A1 * | 11/2021 | Wheatley | E21B 47/02 |

OTHER PUBLICATIONS

Yugay et al. "Well Integrity Management in Brown Fields," SPE-203075 (Year: 2020).*

Srivastava et al. "A Systematic Approach to Monitoring and Management of Annulus Pressures" SPE/IADC-189412-MS (Year: 2018).*

International Search Report PCT/US2020/061106 dated Feb. 10, 2021; 3 pgs.

* cited by examiner

□ = Negative Pressure
⊕ = H1 Alarm
⊗ = H2 Alarm
⊗ = Indication of a Frozen Pressure Transmiter
⊖ = Indication of Closed Valve
● = Pressure Dropped Below Set Value
● = Pressure Risen Above Set Value

| | Flow Status | Tubing (Bar) | Annulus A (Bar) | Annulus B (Bar) | Annulus C (Bar) | Annulus D (Bar) |
|---|---|---|---|---|---|---|
| B-01 | Shut-in | 0.0 | 7.8 | 8.5 | 2.8 | - |
| B-02 | Gas Lift | 31.2 | 141.9 ● | 6.8 | - | - |
| B-03 | Gas Lift | 31.3 | 143.3 | 19.9 | 1.5 | - |
| B-04 | In Test Sep | 32.8 | 127.8 | 12.8 | 7.0 | - |
| B-05 | Shut-in | 5.6 | 62.3 | 18.6 | 7.4 | - |
| B-06 | Shut-in | 0.0 | 1.1 | 1.6 | - | - |
| B-07 | Gas Lift | 28.1 | 132.3 | 0.8 | - | - |
| B-08 | Gas Lift | 31.2 | 143.2 | 14.2 | 2.3 ● | - |
| B-09 | Gas Lift | 27.9 | 138.3 | 11.6 | - | - |
| B-10 | Shut-in | 0.0 | 0.8 | 2.7 | - | - |
| B-11 | Shut-in | 9.6 | 128.1 | 11.0 | 4.7 | - |
| B-12 | Gas Lift | 27.5 | 134.3 | 36.3 | 9.4 | - |

FIG. 7

WELL ANNULUS PRESSURE MONITORING

CROSS-REFERENCE TO RELATED APPLICATIONS

This application is a non-provisional application which claims benefit under 35 USC § 119(e) to U.S. Provisional Application Ser. No. 62/938,814 FILED Nov. 21, 2019, entitled "WELL ANNULUS PRESSURE MONITORING," which is incorporated herein in its entirety.

STATEMENT REGARDING FEDERALLY SPONSORED RESEARCH OR DEVELOPMENT

None.

FIELD OF THE INVENTION

This invention relates to the monitoring of pressure in an annulus of a well such as a well for producing hydrocarbons.

BACKGROUND OF THE INVENTION

A typical well for the production of hydrocarbons, or for injecting fluid into a hydrocarbon formation, comprises a bore hole in a rock formation, into which is inserted one or more diameters of steel casing which may or may not be cemented in place over some or all of its length. Where not cemented, an annular space (annulus) is created between the rock and the casing. Casings of different diameters are normally used, with the diameter decreasing down the well. For part or parts of the length of the well, where there is a transition from one diameter of casing to the next, there may be an overlap where the casings are concentric; this overlap may have substantial length so that a long portion of the well has two casings with an annulus between.

In a producing or injecting well, there will be production tubing passing through the casing (or innermost casing, if there is more than one). There will therefore be an annulus between the (production) tubing and the (inner) casing. This annulus is known as the A annulus, with other annuli being known as B, C, etc as diameter increases. The term "production tubing" will be used generally to refer to the innermost tubing of a well through which hydrocarbons are produced or, in the case of an injection well, through which fluid is injected.

Wells may be monitored by periodically taking readings of pressure in each of the annuli, although this is not routinely done for all annuli. The pressure should be maintained below a safe operating maximum, especially in the tubing and A annulus, and if a pressure reading is above the maximum then remedial action is taken, typically by bleeding off the excess pressure.

The increased pressure may be the result of a leak into or from the annulus or a temperature effect. A stable pressure is often an indication of barriers in good condition, but sometimes a stable pressure is a result of an incorrectly closed or faulty valve or a blockage between the annulus and the pressure transmitter. However, the periodic reading of annulus pressure does not in general indicate the cause of the increased pressure, which must be investigated by other means.

BRIEF SUMMARY OF THE DISCLOSURE

The invention more particularly includes a computer-implemented process for diagnosing problems with a producing hydrocarbon well by monitoring pressure in one or more of production tubing and annuli, the method comprising:

a) correlating certain rates of change of said pressure or certain patterns of variation in said pressure with respective faults or conditions in the well;

b) monitoring said pressure continuously or semi-continuously over time; and c) thereby identifying said faults or conditions as they arise.

The pattern may include the relative variation of pressure over time between two annuli or between production tubing and an annulus.

The process may comprise monitoring pressure in one or more of production tubing and annuli for a predetermined period to establish what patterns of fluctuation of pressure or relative pressure are to be considered normal, and subsequently monitoring the pressure or relative pressure to determine if patterns in the pressure or relative pressure differ by more than a predetermined amount.

Calculation of rate of change of pressure in one or more of production tubing and annuli may further comprise extrapolation of future values of pressure or of future values of pressure difference between tubing and one or more annuli or between two or more annuli. The process may anticipate the future convergence of pressure readings in one or more of production tubing and annuli, e.g. in A and B annuli.

The rate of change of pressure may be monitored over time in production tubing or one or more annuli to establish a datum change rate, and subsequently a pressure change rate which differs from the datum may trigger an alert. In particular, the A annulus may be monitored in this way.

The process may look for negative pressure in the production tubing or any of the annuli and raise an alert to flag this as a potential problem. A negative pressure may be caused by a leak and can mask other leaks. It is considered good practice to have a positive monitoring pressure in each annuli, and the pressures may be different from each other to confirm that the different strings have integrity.

The process may also recognize when a signal from any of the sensors is lost, and raise an alert.

In any of the above processes, the software may be updated by a user rejecting an alert (warning message) raised by the software if the flagged pressure rate or pattern does not in fact represent a problem. The process may involve adjusting the process's tolerances such that a similar rate or pattern does not raise an alert in the future. The adjustment may be for the tolerance in certain parameters or parameter derivative values (e.g. rates of change of parameters) or patterns of parameters/derivatives which prompt an alert, in response to the rejected alert.

Any of the above processes and variations may also involve sensing one or more of the following additional parameters: downhole temperature in production tubing or one or more annuli, flow temperature of produced hydrocarbon or injected fluid (e.g. water), gas lift rate if a well is in gas lift mode, temperature of injected fluid (e.g. water), status of the producing well (e.g. in gas lift mode or natural flow).

What is considered normal for pressure and derivative parameters (e.g rate of change of pressure) in the production tubing or any of the annuli may be affected by one or more of these additional parameters, The process may therefore take into account one or more of the above additional parameters when assessing whether an alert is to be raised.

BRIEF DESCRIPTION OF THE DRAWINGS

A more complete understanding of the present invention and benefits thereof may be acquired by referring to the following description taken in conjunction with the accompanying drawings in which:

FIG. 7 is a display from a system according to the invention.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
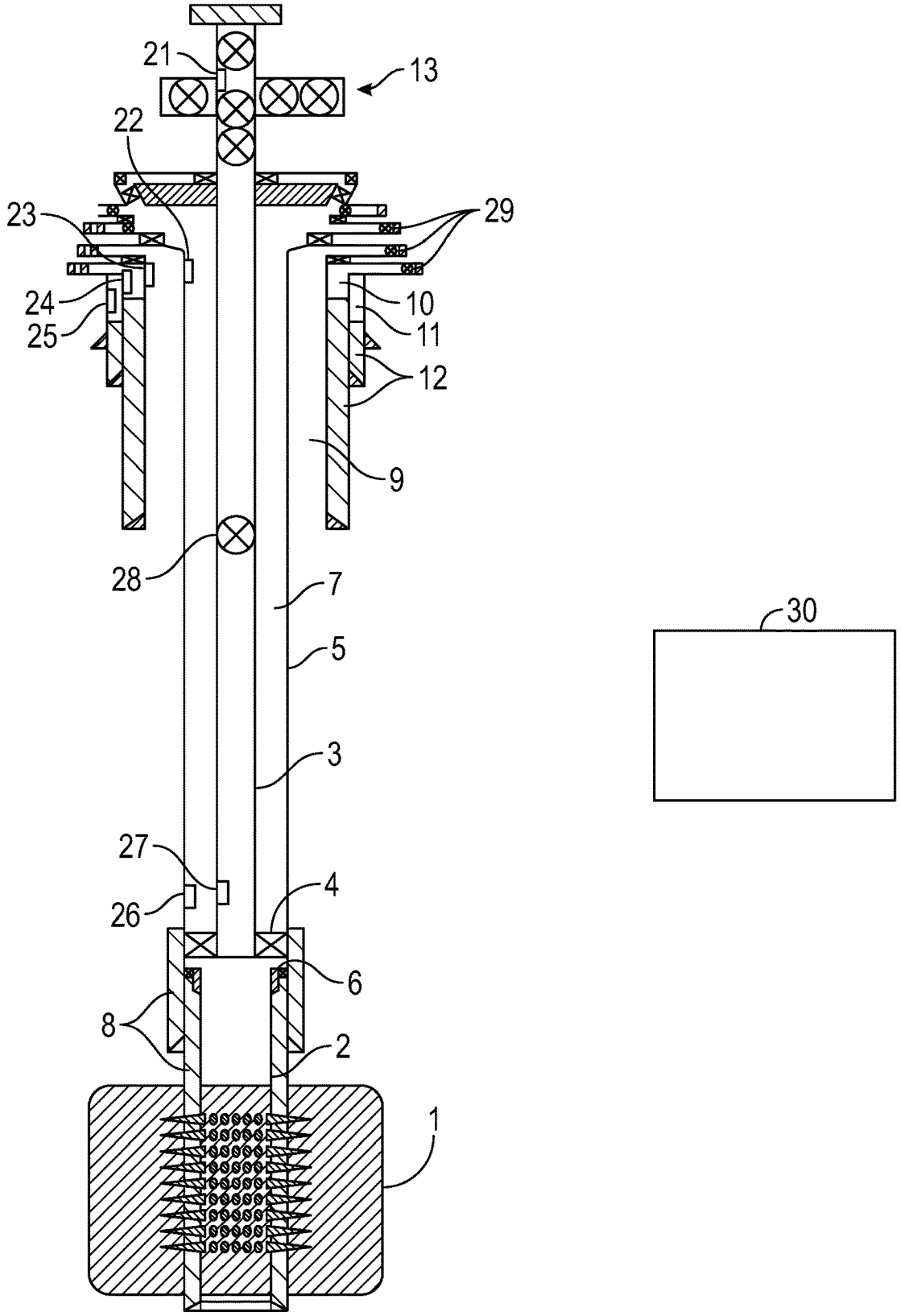
FIG. 1 is a schematic diagram showing in section a producing well with its annuli, together with valves, and sensors connected to a monitoring system.

Referring to FIG. 1, an offshore hydrocarbon well is shown in schematic form, including the wellhead and Xmas tree at the top of the well. The hydrocarbon-bearing formation/reservoir is shown at 1. Extending into the hydrocarbon-bearing reservoir 1 in the subsea rock is the final section of casing or production casing, commonly referred to as the liner 2. The liner 2 is suspended by a liner hanger 6 from intermediate casing 5 (having larger diameter than the liner). The portion of the liner 2 extending into reservoir 1 is perforated in order for hydrocarbons to be produced. The liner may be cemented into the rock by cement 8, as may the lower part of the intermediate casing 5.

Passing down most of the length of the well is the production tubing 3. The production tubing terminates in a production packer 4, set above the liner hanger 6 in the intermediate casing 5. Located within the production tubing is a downhole safety valve 28, whose purpose will be familiar to anyone knowledgeable in this field. An annular space 7, or A annulus, exists between the production tubing and intermediate casing 5.

Larger diameters of casing may be used further up the well, with respective annuli 9, 10, 11 being formed between successively larger casing. The annuli are sequentially referenced B, C, etc. with increasing diameter. These annuli may be partly filled with cement 12.

Each annulus is associated with a respective casing outlet valve 29 (or wing valve), although in FIG. 1 the valve associated with the final annulus is not shown.

The well is provided with a Xmas tree 13, an assembly of valves and conduits which, amongst other things, provides valved access to the production tubing.

Pressure sensors 21, 22, 23, 24, 25 are provided in the production tubing and A, B, C and D annuli respectively. Sensors may also be provided downhole in production tubing or annuli, e.g. sensors 26 and 27 may be provided just above the production packer. Each sensor 21-27 is connected via known means (not shown) such as copper wire, optical fiber or radio link to a computer monitoring system 30. The sensors themselves are of conventional type.

The monitoring system is programmed with software designed to look for certain patters in the behavior of pressure over time either in one annulus (or production tubing), or in the relative pressure between more than one annulus (or production tubing).

Figure 2:
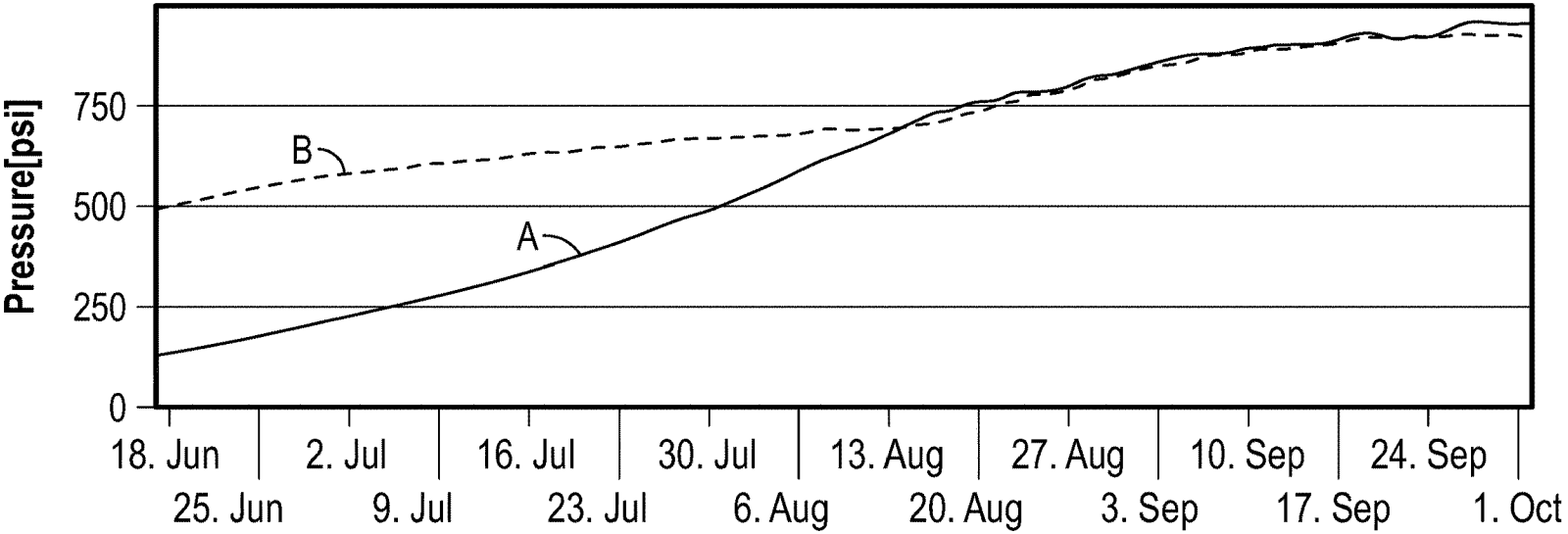
FIG. 2 is a plot over several days of the pressure in annulus A and annulus B, showing a condition which may raise an alert; the pressure is converging until the pressure in annulus A and B is the same—afterwards the pressure is equal, indicating communication between annulus A and B.

Referring now to FIG. 2, a plot is shown of the sensed pressure in the A annulus (plot A) and in the B annulus (plot B). Both pressure readings change over a period of several days. Neither pressure reading reaches a level which is unusual or dangerous and therefore would not normally trigger an alarm of any sort. However, the fact that the pressure readings have equalized is unusual. Although it may be a coincidence, this tends to suggest there may be a leak between the two annuli. An alarm is therefore triggered, including an automated message suggesting that checks are made for a possible leak between the annuli.

Figure 3:
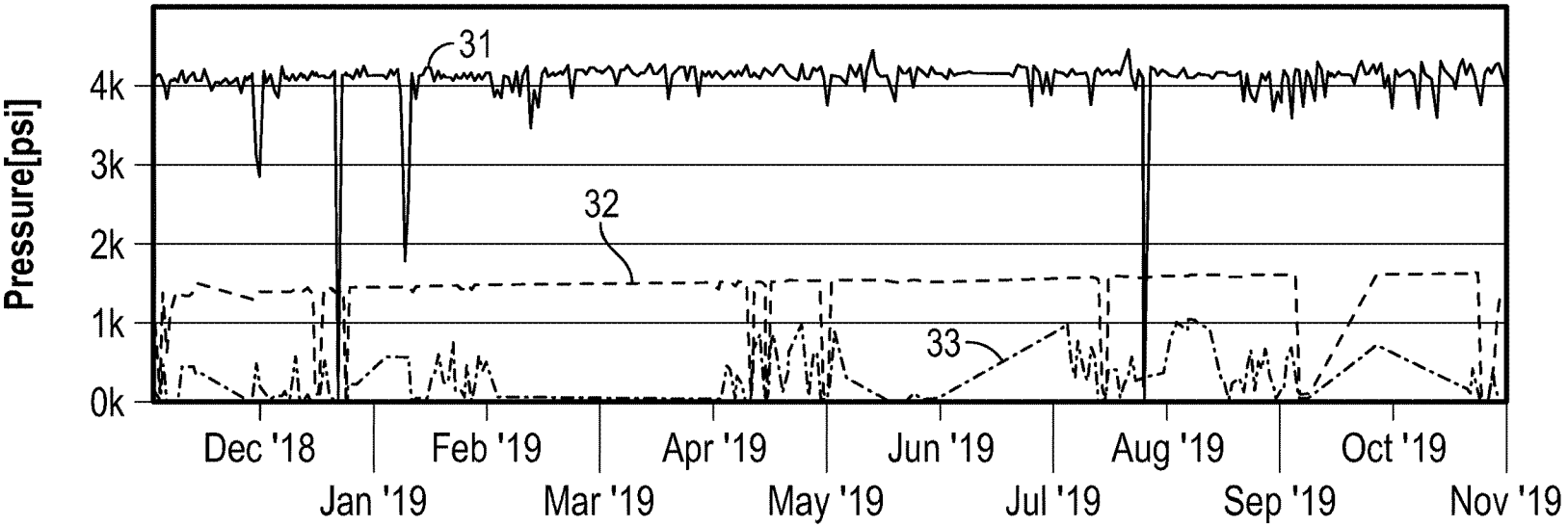
FIG. 3 is a plot of various tubing and annulus pressure readings showing fluctuation over time.

FIG. 3 shows an example pressure plots over a period of a year, including a plot 31 for production tubing, a plot 32 for annulus B and a plot 33 for annulus A. The plots are likely to look different for different wells, so it is almost impossible in all cases to identify by eye what a normal pattern should be. In some cases, pressure fluctuations are the result of particular well interventions. Automatic monitoring of such pressure patterns, with appropriate manual input to identify when well interventions are being carried out, can potentially identify characteristic repeated patterns or "fingerprints" of pressures for a particular well and, once these are established, may automatically monitor for deviations from those patterns.

Figure 4:
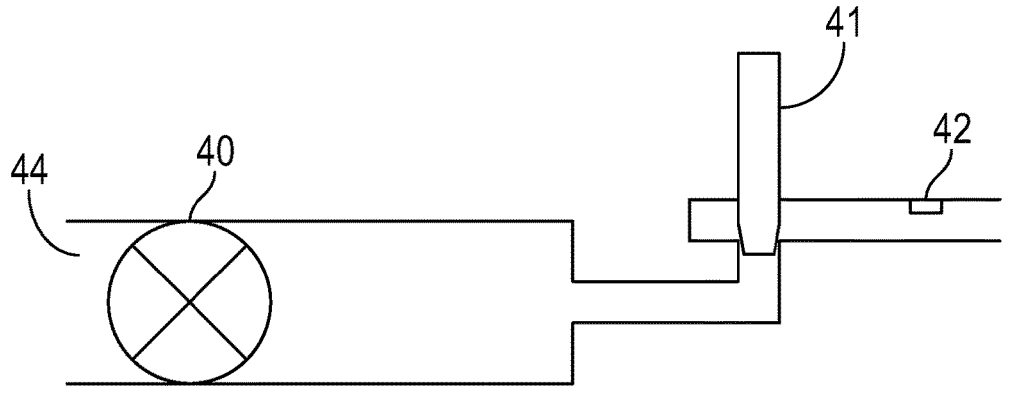
FIG. 4 is a detailed schematic view of a wing valve and associated needle valve and pressure sensor.

FIG. 4 shows the (highly schematic) detail of a so called wing-valve arrangement in a side arm of a wellhead. The passage 44 communicates with the A, B, C or D annulus of a well. The wing valve itself is shown at 40. This is normally maintained open. A needle valve 41 is also provided and, beyond that, a pressure sensor 42. In well interventions, the needle valve is often closed, and it is not uncommon for it to be left closed by mistake after the intervention is completed.

In general terms, the software that can provide alarms once pressure build-up is not as expected (a bit like fingerprinting in the bore). This means that it can capture cases with closed valves, annulus communication, etc. This can be a good aid for field operators for monitoring the wells. Furthermore, the program can calculate annulus leak rates, which avoids the need for a period routine test for such leakage, which is how this check is conventionally made.

The system has data feeds to more than one control center. There is a display for the field operators, including one live display for each platform. In addition, a central control center can have an additional feed. Different levels of seriousness of alarm are provided, which require action from or involvement of different levels of control authority.

In addition to providing the standard regular annulus and tubing pressure alarms, custom alarms are incorporated into the system. The software includes a feature which monitors pressure over a period, e.g. a month or a year, for a specific well to whose monitors it is connected, and establishes what patterns of pressure fluctuation, including fluctuation of the relative pressure of the production tubing and different annuli, are normal. A normally low priority alarm is raised if a pressure pattern is recorded which varies from standard behavior according to certain pre-defined rules or limits.

For example, a sudden increase in annulus pressure, even if the absolute pressure does not reach the required level for an alarm to be raised, would trigger a low level alarm indicating something abnormal may be occurring. A flat annulus pressure (within a certain tolerance) lasting for more than a given period such as an hour or a day would also be indicative of an abnormality, since annulus pressure would normally fluctuate during normal production. Likewise, steadily decreasing pressure can indicate an abnormality.

Figure 5:
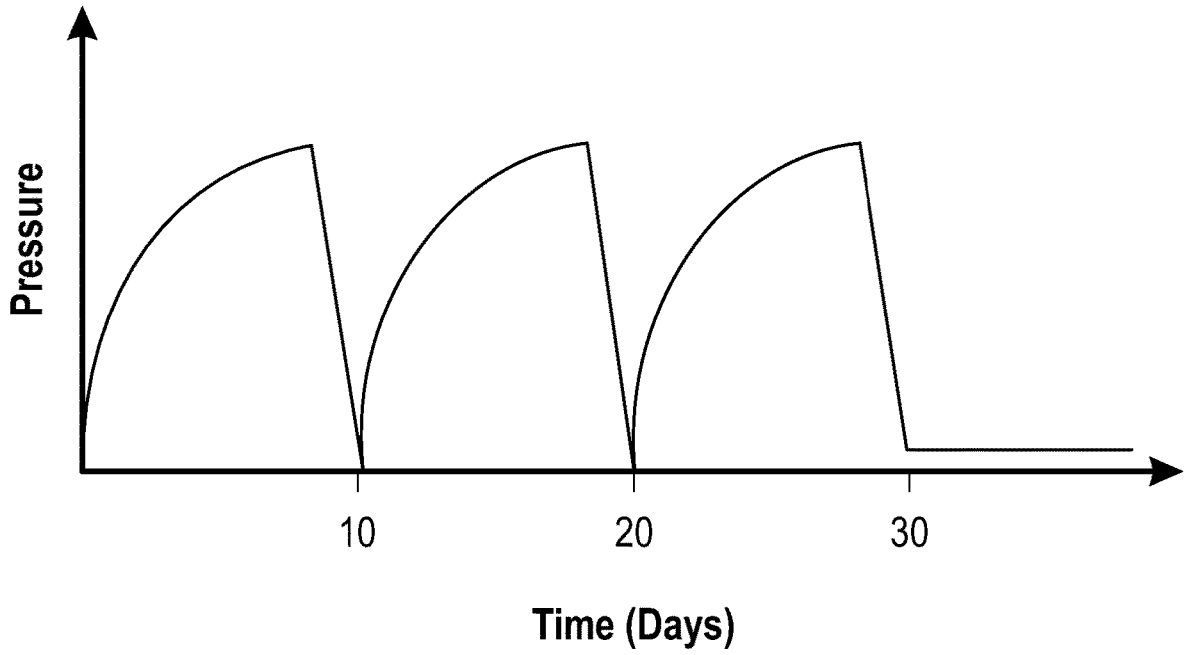
FIG. 5 is a theoretical example of a plot of A annulus pressure over time showing build up and release of pressure.

FIG. 5 shows the normal pattern during production: pressure in the A annulus builds over time to a point where an alarm is raised and it is manually bled off; this process could be automated but at present it is not. The period over which pressure builds is different for different wells and could be a day or a year or anything in between. One embodiment of the invention involves automatically monitoring this pressure over time such that the system "learns" what the normal cycle looks like. If the pressure does not build at the expected rate the system will detect this and raise a low level alarm.

Differential pressures between annuli or between annulus and production tubing can be indicative of burst or collapse of tubing.

Abnormal differential pressures between sensors at different depths may also be indicative of a problem.

The system also includes a facility for a use to dismiss any alarm or alert and send a message to the system that the alarm or alert was raised incorrectly. The software is designed to remember this information and not to raise an alarm or alert in a similar situation in the future. Depending on the type of information which has led to the alarm or alert, the system may automatically increase or reduce threshold values above or below which an alarm or alert is raised, or may change its tolerance values for matching a sensed pressure pattern (or pattern of pressure differences, or pattern of rates of pressure change or other values derived from sensed pressure) with a stored pattern indicative of a potential problem or of acceptable performance.

The system includes other sensors which inform the decision whether to raise an alert or not. For example, the expected A annulus pressure downhole is influenced by the downhole temperature; the expected pressure in an injector well is strongly influenced by the rate of injection of fluid into the well and the temperature of injected fluid. The expected pressures in a well are also of course strongly influenced by the status of the well, e.g. if it is naturally flowing or if gas lift is being employed or even if the well is shut in. The outputs of all these sensors are fed to a diagnosis unit programmed with software which can analyse their significance based on stored data about what pressure thresholds and pressure patterns or rates are appropriate given the state of one or more of these additional parameters.

Figure 6:
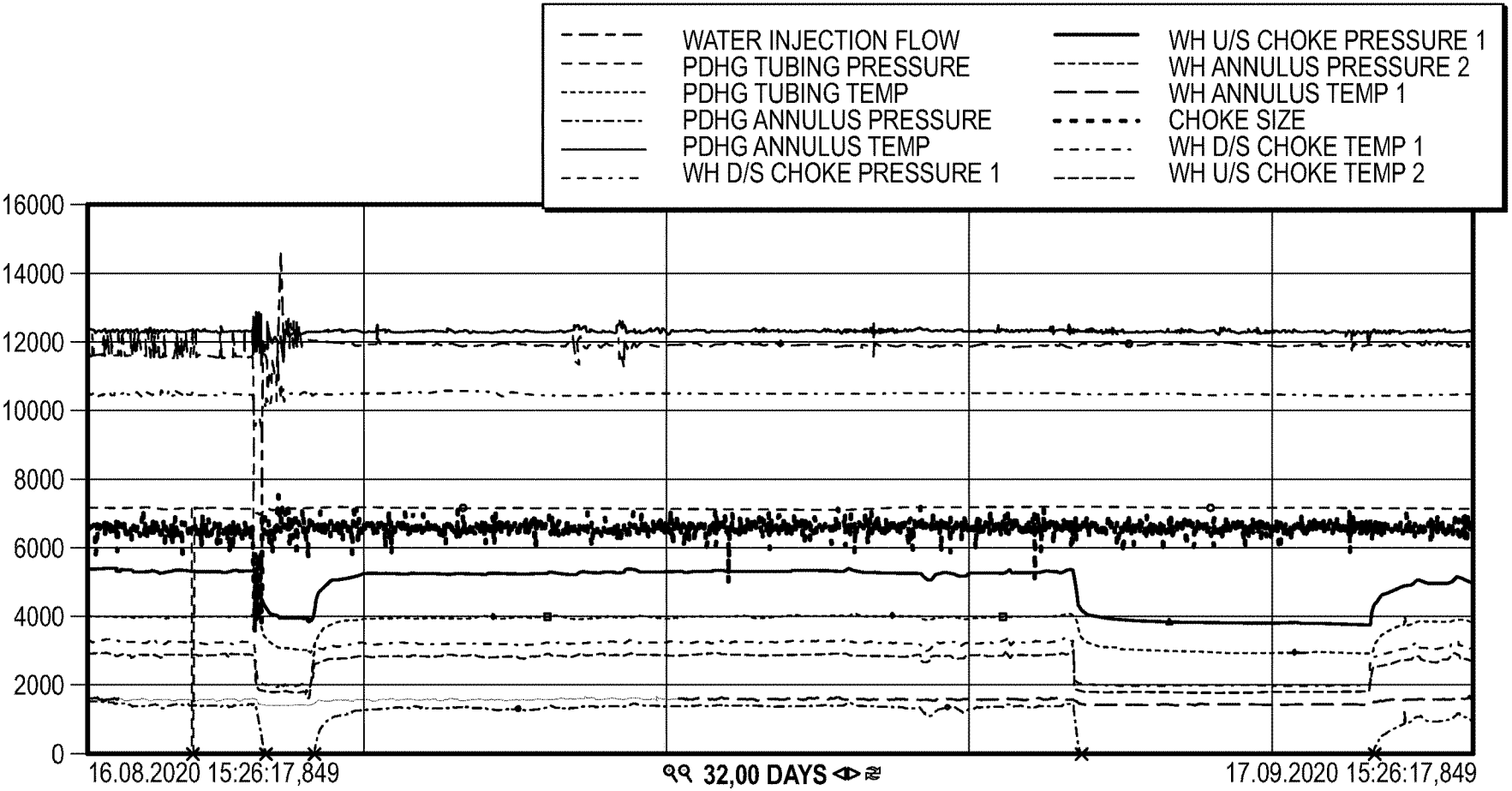
FIG. 6 is a conventional user display plotting outputs of a number of downhole pressure sensors over time.

Referring to FIG. 6, a conventional readout of pressure and temperature plots is shown. A skilled user who is familiar with what the various pressure should be given the temperature readings (and given other factors such as the status of the well) can judge whether the fluctuations in pressure are normal or not. This is a skilled task and it is humanly not possible effectively to compare all the plots in real time, resulting in false alarms and missed faults. Spotting complex patterns of inter-relation between pressures or prediction of such patterns can be beyond a human operator's ability.

A simple version of the system according to the invention has been deployed on a large number of the applicant's wells in the North Sea and has been found to be highly effective. Machine learning aspects of the system and other more advanced features are currently in development, but even in its current form the system has been able to identify and in some cases predict faults and unusual downhole conditions which would have been almost impossible to identify using the previous approach of a user monitoring pressure traces and looking for abnormalities. In the current version, the alarms are as follows:

Negative pressure, flags when the pressure is below 0.
H1 alarm (pressure above set value)
H2 alarm (pressure above operating limit)
Indication of frozen pressure transmitter
Indication of closed valve
The pressure is increasing above set value (derivative). In other words increasing more than expected.
The pressure is decreasing below set value (derivative). In other words decreasing more than expected.

FIG. 7 is a representation of a display from this basic version of the system which shows all the pressures as numerical values and also has a number of alerts, e.g. for excess pressure or an underpressure at one of the sensors and also for unusual pressure differences or anticipated convergence of pressures between two annuli. Even this relatively simple system has proved highly effective on the applicant's wells in the North Sea.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application.

The invention claimed is:

1. A computer-implemented process for diagnosing problems with a hydrocarbon production well by monitoring pressure in an annulus of the well, the method comprising:

a) correlating certain patterns of variation in said pressure with respective conditions in the well;

b) monitoring said pressure continuously over time; and c) thereby identifying said conditions as they arise;

wherein the process further includes a procedure for a user to reject an alert raised by the process because of a detected rate of change of pressure patterns or pressure variation, the process including the step of adjusting a stored pattern indicative of a potential problem or of acceptable performance.

2. The process according to claim 1 comprising monitoring pressure in the annulus for a predetermined period to establish what patterns of variation of pressure are to be considered normal, and subsequently monitoring the pressure to determine if patterns in the pressure differ by more than a predetermined amount from normal.

3. The process according to claim 1 including a procedure for a user to define patterns of variation of pressure that are to be considered normal, patterns of variation of pressure which should trigger an alert.

4. Apparatus for diagnosing problems with a hydrocarbon production well by monitoring pressure in an annulus of the production well, the apparatus comprising:

(a) One or more pressure sensors located in the annulus;

(b) A diagnosis system to which the said sensors are connected; the diagnosis system comprising a processor and memory for executing and storing software for processing data from the sensors;

wherein the diagnosis system correlates certain patterns of variation in said pressure with respective conditions in the well; monitors said pressure continuously over time; and thereby identifies said conditions as they arise;

wherein the system further includes a facility for a user to reject an alert raised by the system because of a detected rate of change of pressure patterns or pressure variation, the system including a facility to adjust a stored pattern indicative of a potential problem or of acceptable performance.

* * * * *